United States Patent [19]

Weetman et al.

[11] Patent Number: 4,571,090

[45] Date of Patent: Feb. 18, 1986

[54] MIXING SYSTEMS

[75] Inventors: Ronald J. Weetman, Rochester; Jerry A. Carpenter, Brockport; Chandler K. Coyle, Pittsford; Keith T. McDermott, Rochester; Roger N. Voss, Dansville, all of N.Y.

[73] Assignee: General Signal Corp., Rochester, N.Y.

[21] Appl. No.: 769,998

[22] Filed: Aug. 26, 1985

Related U.S. Application Data

[63] Continuation of Ser. No. 599,109, Apr. 11, 1984, abandoned.

[51] Int. Cl.[4] ..... B01F 5/10

[52] U.S. Cl. ..... 366/270; 210/219; 366/343

[58] Field of Search ..... 366/270, 330, 343; 261/91; 210/208, 219, 629; 415/213 A, 213 C; 416/223 R, 228 R, 231 A

[56] References Cited

U.S. PATENT DOCUMENTS

| | | | |
|---|---|---|---|
| 1,293,381 | 2/1919 | Dupuy . | |
| 1,981,392 | 11/1934 | Selman . | |
| 2,592,876 | 4/1952 | Earle et al. . | |
| 3,174,313 | 3/1965 | Crosby et al. | 366/270 X |
| 3,367,423 | 2/1968 | Van Ranst | 416/223 R |
| 3,477,382 | 11/1969 | Watson . | |
| 3,499,633 | 3/1970 | Bowen, Jr. | 366/270 X |
| 3,564,651 | 2/1971 | Covington, Jr. et al. . | |
| 4,135,858 | 1/1979 | Entat | 416/223 R |
| 4,147,437 | 4/1979 | Jonqueres | 366/343 |
| 4,231,974 | 11/1980 | Engelbrecht | 261/87 |
| 4,240,990 | 12/1980 | Inhofer et al. | 210/219 X |
| 4,358,206 | 11/1982 | Schutte | 366/262 |

FOREIGN PATENT DOCUMENTS

| | | | |
|---|---|---|---|
| 78660 | 5/1983 | European Pat. Off. | 366/330 |
| 2844113 | 4/1980 | Fed. Rep. of Germany | 210/219 |
| 427190 | 4/1935 | United Kingdom | 416/228 R |

OTHER PUBLICATIONS

Willis, David P., Jr., "Fighting Friction With Bonded Coatings", *Machine Design,* Apr. 10, 1980, pp. 124–127.

Willis, David P., Jr., "Increasing Lifetime With Fluoropolymer Coatings", *Appliance Engineer,* vol. 7, No. 1, 1973.

"TIVAR(R)-VHMW Polymer", by Poly-Hi Menasha Corporation (Product Bulletin).

*Primary Examiner*—Philip R. Coe

*Attorney, Agent, or Firm*—M. Lukacher; J. S. Mednick

[57] ABSTRACT

Mixing systems for liquids having fibers suspended therein wherein the fibers tenaciously adhere to and accumulate on the leading edge of the impeller, thereby increasing the drag of the liquid on the impeller as it rotates and the consequent increase in the power required to rotate the impeller. Axial flow of the liquid in a tank is produced by the impeller within a draft tube. The leading edge of the blades of the impeller are inclined with respect to radial lines extending from the axis of rotation of the impeller beyond the angle of repose of the fibers on the leading edge. Also, the coefficient of friction of the portion of the impeller, extending from the leading edge toward the trailing edge thereof, to which the fibers adhere is reduced by providing the surface thereof with a low coefficient of friction material.

40 Claims, 5 Drawing Figures

MIXING SYSTEMS

This is a continuation of application Ser. No. 599,109, filed 4/11/84 and now abandoned.

The present invention relates to mixing systems, and particularly to methods and apparatus for mixing and circulating liquids having fibers suspended therein.

The present invention is especially suitable for use in mixing systems designed to treat waste water by the circulation of the water in tanks with an axial flow impeller in a draft tube. The invention is also suitable for use in other mixing applications liquid is circulated with an axial flow impeller.

When waste water is mixed in tanks, as in the course of waste water treatments such as aeration, the power necessary to drive the impeller has been found to increase. After a period of time, which may be from one hour to four days, the required power to circulate the waste water sufficiently to mix and aerate it may increase up to 50%. The problem may be overcome by utilizing drive motors of higher power rating and bearing the cost of the increased power.

The cause of this problem escaped appreciation until the time of this invention. In accordance with this invention, it was discovered that the drag on the impeller increased with time as a consequence of the accumulation of fibers on the leading edge of the impeller. In waste water, which arrives from a sewage system for treatment, the fibers are hair, rags (such as diapers and feminine products) and plastic bags. Other fiberous materials suspended in the liquid, which is circulated and mixed, also accumulates on the leading edge of the impeller with the same adverse effect.

The problem has been found, in accordance with the invention, to be exacerbated when the liquid containing the fibers in suspension is circulated and mixed with an axial flow impeller in a draft tube arrangement. Then the velocity of the impeller blades through the liquid is several times the velocity of the liquid in the direction axially of the impeller and draft tube. There are components of drag on each of the ends of the fiber which are disposed on opposite sides of the leading edge of the blades of the impeller; thereby leaving no net force tending to pull the fiber off the impeller. The result of these drags is a force having a component normal to the leading edges of the impeller blades which holds the fibers on the leading edges, the fibers therefore cling tenaciously to the leading edges. In time the fibers accumulate and present a rough surface on the leading edge and around the leading portion of the blades which progressively increases the drag, decreases the lift and flow (pumping) and requires more and more driving power to maintain the velocity of the impeller necessary to obtain sufficient axial flow and circulation of the liquid. The efficiency and performance of the mixing system is therefore derrogated.

Accordingly, it is the principal object of the present invention to provide an approved mixing system whereby mixing can be carried out with low drag on the impeller which circulates and mixes a liquid in spite of the presence of fibers, in suspension, in the liquid.

It is a further object of the present invention to provide improved methods of and apparatus for mixing liquids, the performance and efficiency of which is not reduced when fibers are suspended in the liquid being mixed.

It is a still further object of the present invention to provide improved mixing apparatus wherein axial flow is produced within a draft tube with an impeller having low drag characteristics even in the presence of fibers in the liquid being mixed.

Briefly described, a system for mixing liquids in a tank in accordance with the invention utilizes an impeller which has opposite edges which respectively lead and trail each other as the impeller rotates. This system is operative to circulate the liquids through the tank along a flow path which extends axially of the impeller. The adhesion of fibers suspended in the liquid along the leading edge of the impeller is decreased, thereby preventing increased drag on the impeller due to the accumulation of the fibers on the leading edge as the impeller rotates. The adhesion is decreased by inclining the leading edge with respect to a radial line from the axis of the impeller sufficiently to be greater than the angle of repose of the fibers on the impeller. The angle of repose is that angle where the forces normal to the leading edge are sufficient to hold the fibers against the leading edge, considering the coefficient of friction of the surface of the impeller at the leading edge with respect to the fibers. Mechanically, the leading edge presents an inclined plane with an inclination larger than the angle of repose. Accordingly, the fibers are not held with sufficient force to maintain them on the leading edge and they continue to circulate with the liquid. This is in spite of the absence of any significant radial component of flow; the flow being essentially axial, particularly where the impeller is an axial flow impeller in a draft tube. The adhesion of the fibers along the leading edge may also be decreased by providing the portion of the impeller adjacent the leading edge with a surface of low coefficient of friction material, such a low coefficient of friction may be provided by polishing. Low coefficient of friction material is preferably provided by utilizing a plastic material presenting a low coefficient of friction to the fibers.

The foregoing and other objects, features and advantages of the invention, as well as presently preferred embodiments thereof and the best modes presently known for practicing the invention, will become more apparent from a reading the following description in connection with the accompanying drawings in which.

Figure 1:
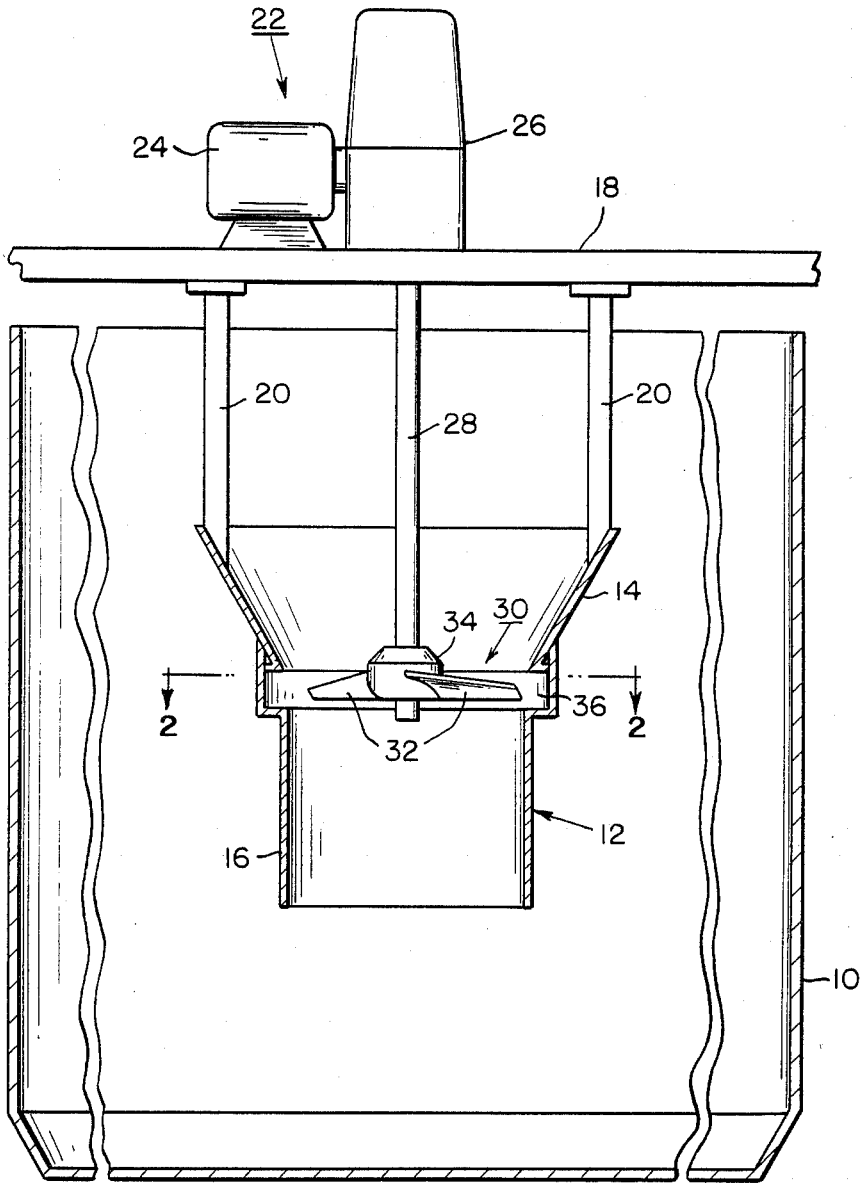
FIG. 1 is a sectional view, in elevation, of a mixing system embodying the invention.

Referring more particularly to FIG. 1, there is shown a tank 10 which may be used for the mixing of liquids, such as waste water, having fibers in suspension. A draft tube 12, having a conical upper section 14 and a cylindrical lower section 16, is suspended from a beam 18 by posts 20. The lower section may also be diverging. The beam 18 also carries a drive assembly 22 including an electric motor 24 and gearing 26. Suitable bearings in the gearing section 26 rotatably support a drive shaft 28. An impeller 30 having a plurality of blades 32 is connected to a hub 34 which is connected to and driven by the drive shaft 28. The draft tube sections 14 and 16 define an impeller way 36. When the system is used for mixing and aerating, a sparge ring may be mounted below the impeller 30 in the lower section 16. Alternatively, air may be inducted through holes in the blades for sparging purposes as described in U.S. Pat. No. 4,231,974. The operation and advantages of the impeller way 36 are described in U.S. Pat. No. 3,477,382. Further information respecting the design of draft tube mixing systems may also be obtained from U.S. Pat. No. 4,385,206.

Figure 2:
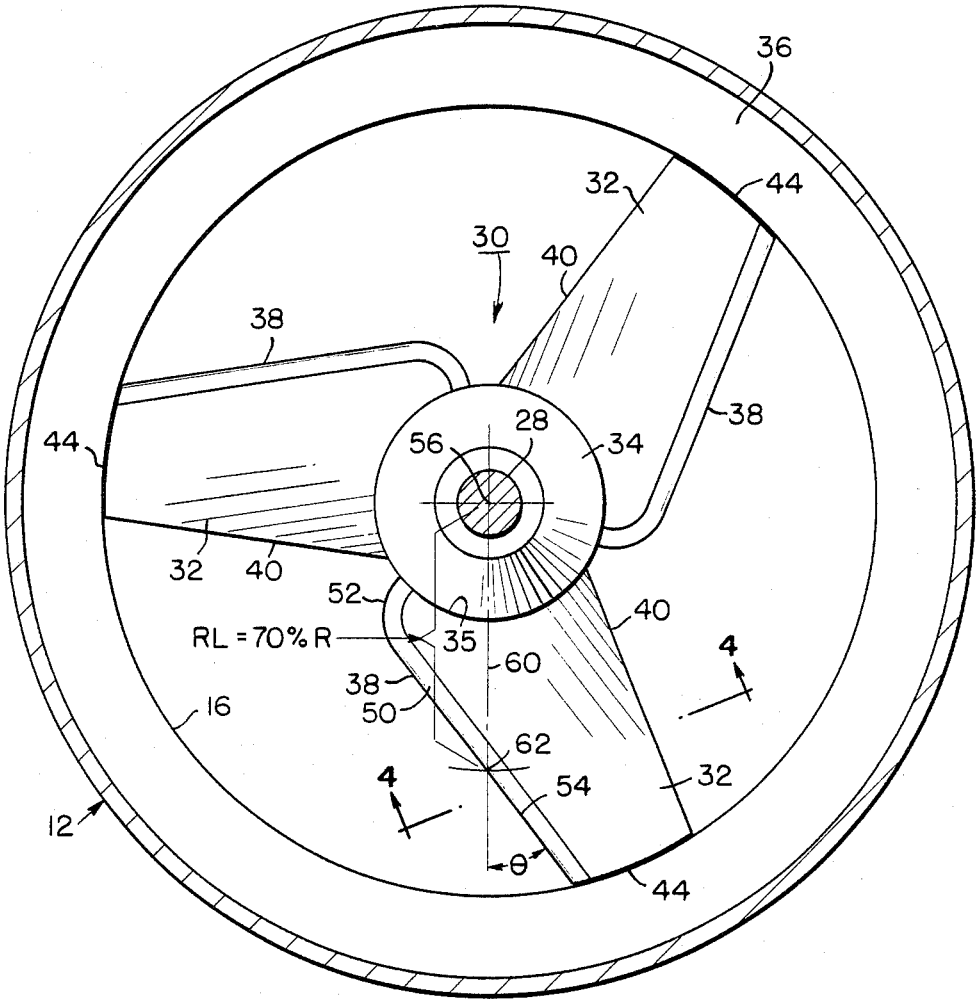
FIG. 2 is a sectional view taken along the line 2—2 in FIG. 1, illustrating the low drag impeller provided in accordance with an embodiment of the invention in greater detail.

The impeller 34 is an axial flow impeller. Each of the blades have an airfoil shape and cause the liquid in the tank to be circulated through the draft tube, preferably downwardly when the system is used for mixing and aerating, although upward circulation may also be used. Vanes (not shown), for example as described in U.S. Pat. No. 4,231,974, may be used to further direct the flow axially of the impeller. The impeller has a plurality of blades, three blades 32 being used as shown in FIG. 2. Each of the blades is identical to the others. They are mounted 120° apart on the hub 34 and may be welded at their bases 35 to the hub 34.

Figure 3:
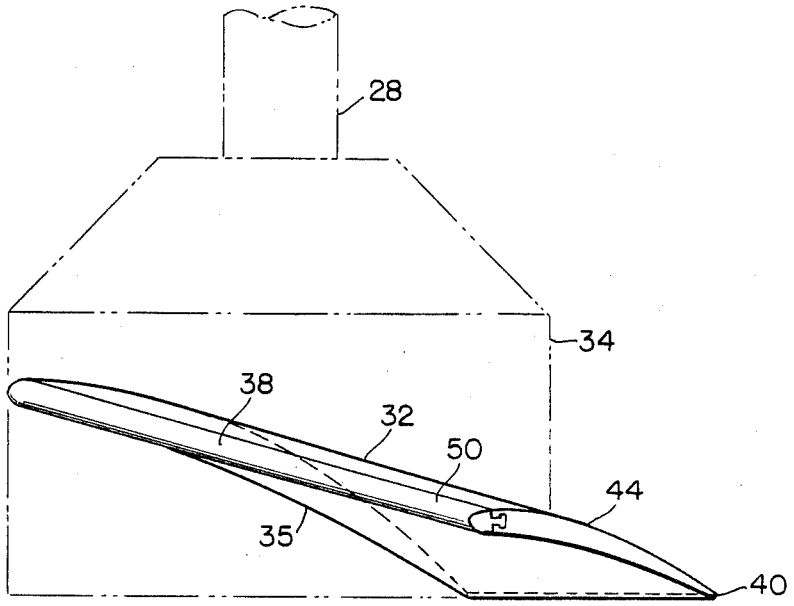
FIG. 3 is an enlarged view, in elevation, illustrating one of the blades of the impeller shown in FIGS. 1 and 2.
Figure 4:
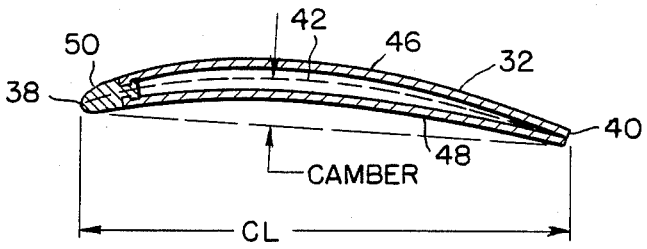
FIG. 4 is a sectional view of one of the blades of the impeller illustrating its airfoil shape and designating the chord, camber and thickness of the blade, the section being taken along the line 4—4 in FIG. 2.

As shown in FIGS. 3 and 4, each blade 32 has an airfoil profile. The chord of the blade (CL) is measured between its leading edge 38 and its trailing edge 40. The blade has camber as measured between its midline 42 and chord. The blade also has twist, as shown in FIG. 3, in that the angle between the chord and the lower surface of the blade is greater at the base 35 of the blade than at the tip 44 thereof, and may be 10°–18° greater. In order to provide for axial flow, the camber may have a maximum length or value of from about 4 to 8 percent of the chord length. The location of the maximum camber length may be from about 20% to about 60% of the chord length away from the leading edge 38 towards the trailing edge 40. The blade also has thickness between its upper and lower surfaces preferably from about 6 to 14 percent of the chord length. The width of the blade at the hub may be 22–28% of the chord length. The width of the blade at the tip may be 14–20% of the chord length. The tip chord angle (between the chord at the tip and the horizontal) may be 5°–25°. The blade may be constructed from a pair of plates 46 and 48, as shown in FIG. 4 which may be welded together near the leading and trailing edges. An insert 50 is provided in a portion extending approximately 10 percent of the length of each of the upper and lower surfaces from the leading to the trailing edges 38 and 40 of each blade 32. This insert is preferably a body of plastic materials which presents a surface having a low coefficient of friction. A suitable material is ultra high molecular weight polyethlene ("UHMW"). The molecular weight of this material is approximately 5 million. Suitable material is available from Poly-Hi/Menasha Corp. under the trade name TIVAR ®. Other material presenting a low coefficient of friction is suitable, for example a flouropolymer (such as known by the trade name Teflon). Ultra high molecular weight polyethelene is preferred.

It will also be observed that the tips 44 of the blades 32 have the shape of a sector of a circle and conform to the cylindrical inner periphery of the draft tube; extending to the inner periphery of the lower section 16, and separated therefrom only the necessary clearance to maintain manufacturing tolerances. The leading edge 38 is also longer than the trailing edge 40. The leading edge has an arcuate section 52 near the base end 35 and extends to a straight section 54. The trailing edge 40 is entirely straight. The arcuate section 52 is provided in order that the inclination of the leading edge can be sufficient so that the angle of repose of fibers which tend to accumulate on the leading edge is not reached. This angle of repose may be measured between the leading edge and radial lines extending from the axis 56 of the impeller (the center line of the shaft 28 and hub 34). In a preferred embodiment, the angle indicated as, $\theta$, in FIG. 2 between a radial line 60 in a plane perpendicular to the axis 56 which intersects the leading edge 38 at a point 62, where the radial line has a length, RL, equal to 70 percent of the radius of the blade from the tip 44 to the axis 56, is 40°. This angle of inclination, $\theta$, may be in a range from 20° to 60° depending upon the nature of the fibers which are suspended in the liquid being mixed and the coefficient of friction of the surface provided by the insert 50.

In some cases, in lieu of such an insert with low coefficient of friction, a sufficient inclination angle $\theta$ will suffice. Also, instead of providing an insert to present the portion of the surface at the leading edge with a low coefficient of friction, the portion may be polished. In lieu of an insert 50 the low coefficient of friction material may be coated or otherwise bonded onto the surface. For further information on coating techniques reference may be had to D. P. Willis, Jr., Increasing Lifetime with Flouropolymer Coatings, Appliance Engr. Vol. 7, No. 1 (1973 and D. P. Willis, Jr., Machine Design, April 10, 1980, pp. 123–127.

Figure 5:
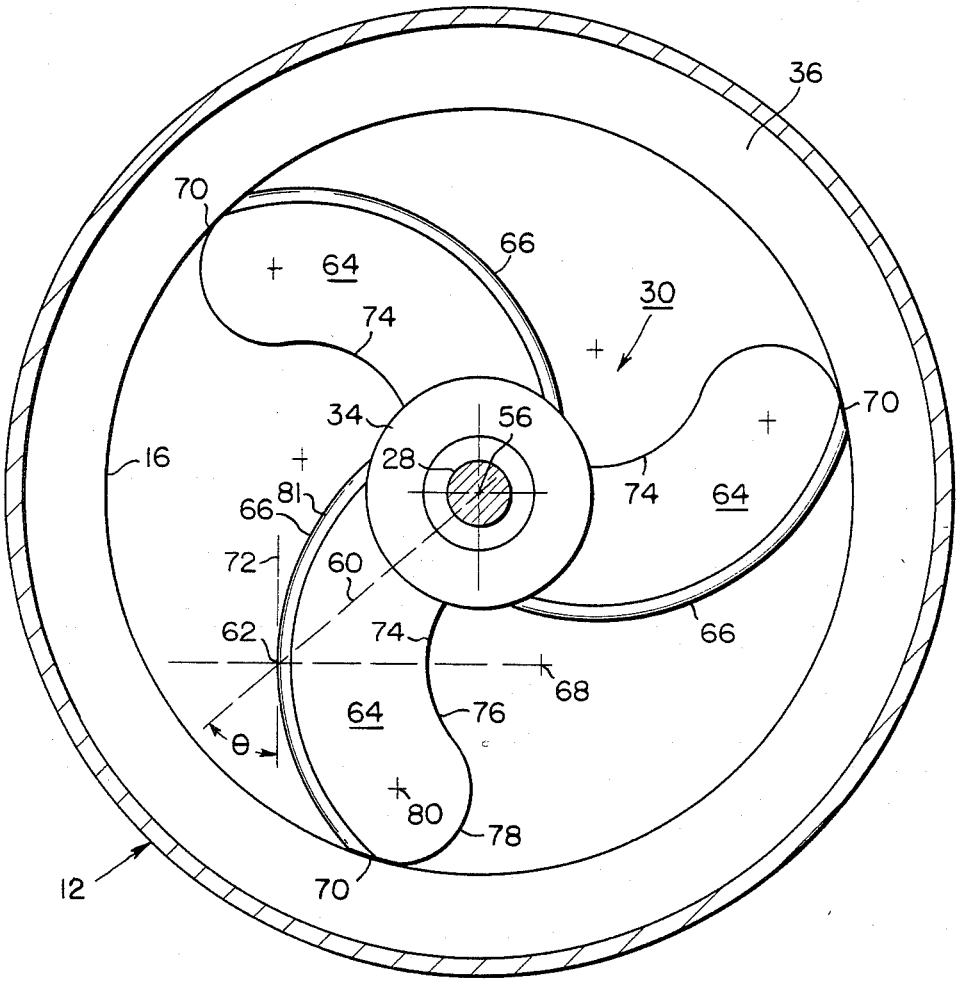
FIG. 5 is a view similar to FIG. 2 illustrating a low drag impeller in accordance with another embodiment of the invention.

In the event that increased angles of inclination are desired, for example 50° or more the impeller 30 may be provided with blades 64 of a design shown in FIG. 5. These blades may be of airfoil profile their leading edges 66 are sectors of a circle. The angle of inclination, $\theta$, as in FIG. 2, is measured at the intersection 62 of the radial line 60 of length 70% of the radius to the top 70 of the blade with the leading edge 66. The angle included between the radial line 60 and a line 72 tangent to the leading edge 66 at the point 68. The center of the sector is shown at 68 along a line perpendicular to tangent line 72.

The trailing edge 74 of the blade is made up of two arcs, one of which 76 is a sector of a circle having its center at 68 and the other of which 78 is also a sector of a circle having its center 80 within the blade 64.

The portion 81 of the blade adjacent the leading edge 66 may be provided by an insert of low coefficient of friction material, similar to the insert 50. The other techniques mentioned above, for providing low coefficient of friction in the surfaces of the portion 81, may alternatively be used.

From the foregoing description it will be apparent that there has been provided an improved mixing system in which axial flow for circulation and mixing of liquids is provided without the derrogation of efficiency and performance which results from fibers suspended in the liquid being circulated and mixed. Variations and modifications in the herein described system, within the scope of the invention, will undoubtedly suggest themselves to those skilled in the art. Accordingly, the foregoing description should be taken as illustrative and not in a limiting sense.

We claim:

1. Apparatus for circulating liquids having fibers suspended therein in a region containing said liquids which comprises a draft tube disposed in said region containing said liquids, a shaft, an axial flow impeller having a plurality of blades, said impeller being disposed in said draft tube on said shaft, said shaft and said impeller being coaxial with said tube, said blades having opposite edges one of which leads the other as said impeller rotates, said leading edges being inclined with respect to radial lines from the axis of said impeller in planes perpendicular to said axis at angles greater than the angle of repose of said fibers on said impeller as said impeller rotates through said liquids and said liquids flow in the direction axially of said impeller through said draft tube thereby preventing the accumulation of said fibers on said leading edge and the increase of drag on said impeller which prevents the rotation thereof at sufficient speed to circulate said liquids without increasing the power applied to rotate said shaft.

2. The apparatus according to claim 1 wherein the angles between the ones of said radial lines which intersects said leading edges where said one radial lines are 70% of the radius from the axis of said impeller to the tips of said blades are from 20° to 60°.

3. The apparatus according to claim 2 further comprising a hub on said shaft, said blades being connected to said hub, the portions of said leading edges of said blades adjacent to said hub being along an arcuate curve and the remainder of said leading edges between said tip and said portions being along straight lines.

4. The invention according to claim 3 wherein said angles between said one radial lines and said straight line portions of said blades is about 40°.

5. The apparatus according to claim 2 wherein said trailing edges of said blades define angles with radial lines from the axis of said impeller in planes perpendicular thereto which intersects said trailing edges which last named angles are smaller than said angles between said leading edges and said radial lines which intersect said leading edges.

6. The apparatus according to claim 5 wherein said trailing edges are along straight lines.

7. The apparatus according to claim 2 wherein said blades have airfoil cross-sectional profiles.

8. The apparatus according to claim 7 wherein said blades have camber, thickness distribution and twist.

9. The apparatus according to claim 8 wherein said camber has a length from about 4% to 8% of the length of the chord of said blades between said leading and trailing edges thereof and said maximum thickness is from 6% to 12% of said chord length, and wherein the angle between said chord and planes perpendicular to said axis is greater adjacent to said hub than adjacent to said tips of said blades and varies therebetween.

10. The apparatus according to claim 2 further comprising a hub connecting said blades to said shaft and wherein said leading edges are arcuate from the tips of said blades to said hub, said angles to said radial lines being between tangents to said leading edge and said radial lines.

11. The apparatus according to claim 10 wherein said leading edges are along sectors of circles.

12. The apparatus according to claim 11 wherein the sectors of said leading edges have their centers along lines perpendicular to lines tangent to said leading edges where said radial lines are 70% of the radius of said blades from said axis to the tips thereof.

13. The apparatus according to claim 12 wherein said trailing edges of each of said blades are sectors of circles the one of which adjacent to said hub having the same center as the leading edge thereof and the other of which sectors has its center inwardly thereof.

14. The apparatus according to claim 10 wherein said trailing edges are also arcuate.

15. The apparatus according to claim 1 wherein said blades have opposite surfaces portions of which extending from said leading edges to said trailing edges are of material having lower coefficient of friction than the remainder of said blade surfaces.

16. The apparatus according to claim 15 wherein said portions extend about 10% of the length of said surfaces from said leading to said trailing edges thereof.

17. The apparatus according to claim 16 wherein said portions are provided by inserts which define said leading edges and provide said surfaces.

18. The apparatus according to claim 17 wherein said material of said inserts is plastic.

19. The apparatus according to claim 18 wherein said plastic material is selected from the group consisting of high molecular weight polyethylene and fluoropolymers.

20. Apparatus for circulating liquids having fibers suspended therein in a region containing said liquids which comprises a shaft in said region containing said liquids, an axial flow impeller having a plurality of blades, said impeller being disposed in said tank on said shaft, said blades having opposite edges one of which leads the other as said impeller rotates, said leading edges being inclined with respect to radial lines from the axis of said impeller in planes perpendicular to said axis at angles greater than the angle of repose of said fibers on said impeller as said impeller rotates through said liquids and said liquids flow in the direction axially of said impeller thereby preventing the accumulation of said fibers on said leading edge and the increase of drag on said impeller which prevents the rotation thereof at sufficient speed to circulate said liquids without increasing the power applied to rotate said shaft.

21. The apparatus according to claim 20 wherein the angles between the ones of said radial lines which intersects said leading edges where said one radial lines are 70% of the radius from the axis of said impeller to the tips of said blades are from 20° to 60°.

22. The apparatus according to claim 21 further comprising a hub on said shaft, said blades being connected to said hub, the portions of said leading edges of said blades adjacent to said hub being along an arcuate curve and the remainder of said leading edges between said tip and said portions being along straight lines.

23. The invention according to claim 22 wherein said angles between said one radial lines and said straight line portions of said blades is about 40°.

24. The apparatus according to claim 21 wherein said trailing edges of said blades define angles with radial lines from the axis of said impeller in planes perpendicular thereto which intersects said trailing edges which last named angles are smaller than said angles between said leading edges and said radial lines which intersect said leading edges.

25. The apparatus according to claim 24 wherein said trailing edges are along straight lines.

26. The apparatus according to claim 21 wherein said blades have airfoil cross-sectional profiles.

27. The apparatus according to claim 26 wherein said blades have camber, thickness distribution and twist.

28. The apparatus according to claim 27 wherein said camber has a length from about 4% to 8% of the length of the chord of said blades between said leading and trailing edges thereof and said maximum thickness is from 6% to 12% of said chord length, and wherein the angle between said chord and planes perpendicular to said axis is greater adjacent to said hub than adjacent to said tips of said blades and varies therebetween.

29. The apparatus according to claim 21 further comprising a hub connecting said blades to said shaft and wherein said leading edges are arcuate from the tips of said blades to said hub, said angles to said radial lines being between tangents to said leading edge and said radial lines.

30. The apparatus according to claim 29 wherein said leading edges are along sectors of circles.

31. The apparatus according to claim 30 wherein said trailing edges are also arcuate.

32. The apparatus according to claim 30 wherein the sectors of said leading edges have their centers along lines perpendicular to lines tangent to said leading edges where said radial lines are 70% of the radius of said blades from said axis to the tips thereof.

33. The apparatus according to claim 32 wherein said trailing edges of each of said blades are sectors of circles the one of which adjacent to said hub having the same center as the leading edge thereof and the other of which sectors has its center inwardly thereof.

34. The apparatus according to claim 20 wherein said blades have opposite surfaces portions of which extending from said leading edges to said trailing edges are of material having lower coefficient of friction than the remainder of said blade surfaces.

35. The apparatus according to claim 34 wherein said portions extend about 10% of the length of said surfaces from said leading to said trailing edges thereof.

36. The apparatus according to claim 35 wherein said portions ar provided by inserts which define said leading edges and provide said surfaces.

37. The apparatus according to claim 36 wherein said material of said inserts is plastic.

38. The apparatus according to claim 37 wherein said plastic material is selected from the group consisting of high molecular weight polyethylene and fluoropolymers.

39. The apparatus according to claim 1 wherein said region containing said liquids is a tank.

40. The apparatus according to claim 20 wherein said region containing said liquids is a tank.

* * * * *

REEXAMINATION CERTIFICATE (694th)

United States Patent [19]

Weetman et al.

[11] B1 4,571,090

[45] Certificate Issued Jun. 2, 1987

[54] MIXING SYSTEMS

[75] Inventors: Ronald J. Weetman, Rochester; Jerry A. Carpenter, Brockport; Chandler K. Coyle, Pittsford; Keith T. McDermott, Rochester; Roger N. Voss, Dansville, all of N.Y.

[73] Assignee: General Signal Corp., Rochester, N.Y.

Reexamination Request:
No. 90/001,012, May 20, 1986

Reexamination Certificate for:

| | |
|---|---|
| Patent No.: | **4,571,090** |
| Issued: | **Feb. 18, 1986** |
| Appl. No.: | **769,998** |
| Filed: | **Aug. 26, 1985** |

Related U.S. Application Data

[63] Continuation of Ser. No. 599,109, Apr. 11, 1984, abandoned.

[51] Int. Cl.[4] ..... B01F 5/10

[52] U.S. Cl. ..... 366/270; 210/219; 366/343

[56] References Cited

U.S. PATENT DOCUMENTS

| | | | |
|---|---|---|---|
| 885,174 | 4/1908 | Perkins . | |
| 1,593,516 | 7/1926 | Sutter . | |
| 1,850,199 | 3/1932 | Bryant . | |
| 3,168,255 | 2/1965 | Bellows et al. | 241/46 |
| 3,514,216 | 5/1970 | McAninch | 230/120 |
| 3,532,327 | 10/1970 | Landberg | 259/95 |
| 3,564,651 | 2/1971 | Covington, Jr. et al. | 18/12 |
| 4,076,179 | 2/1978 | Tsukube | 241/46.11 |
| 4,089,620 | 5/1978 | Ravitts | 417/61 |
| 4,155,602 | 5/1979 | Quick | 406/104 |
| 4,468,130 | 8/1984 | Weetman | 366/330 |
| 4,474,479 | 8/1982 | Redelman | 366/300 |
| 4,575,256 | 9/1983 | Armitage et al. | 366/266 |

FOREIGN PATENT DOCUMENTS

| | | |
|---|---|---|
| 0079396 | 9/1980 | European Pat. Off. . |
| 500266 | 10/1927 | Fed. Rep. of Germany . |
| 7806626 | 12/1979 | Netherlands . |
| 296247 | 8/1928 | United Kingdom . |
| 1026384 | 5/1963 | United Kingdom . |
| 1454277 | 11/1976 | United Kingdom . |
| 2113570 | 8/1983 | United Kingdom . |

*Primary Examiner*—Philip R. Coe

[57] ABSTRACT

Mixing systems for liquids having fibers suspended therein wherein the fibers tenaciously adhere to and accumulate on the leading edge of the impeller, thereby increasing the drag of the liquid on the impeller as it rotates and the consequent increase in the power required to rotate the impeller. Axial flow of the liquid in a tank is produced by the impeller within a draft tube. The leading edge of the blades of the impeller are inclined with respect to radial lines extending from the axis of rotation of the impeller beyond the angle of repose of the fibers on the leading edge. Also, the coefficient of friction of the portion of the impeller, extending from the leading edge toward the trailing edge thereof, to which the fibers adhere is reduced by providing the surface thereof with a low coefficient of friction material.

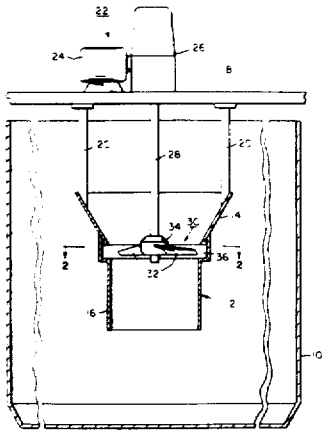

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–40 is confirmed.

* * * * *